US011407583B2

(12) United States Patent
Diaz Cuesta et al.

(10) Patent No.: US 11,407,583 B2
(45) Date of Patent: Aug. 9, 2022

(54) INTERMEDIATE BULK CONTAINER

(71) Applicant: Schoeller Allibert GmbH, Schwerin (DE)

(72) Inventors: Juan Jose Diaz Cuesta, Barcelona (ES); Ignacio Marcoartu Beascoechea, Bilbao (ES); Erik Brinkers, TT Emmen (NL); Ricard Duran Soler, Barcelona (ES)

(73) Assignee: SCHOELLER ALLIBERT GMBH, Schwerin (DE)

( * ) Notice: Subject to any disclaimer, the term of this patent is extended or adjusted under 35 U.S.C. 154(b) by 196 days.

(21) Appl. No.: 16/698,004

(22) Filed: Nov. 27, 2019

(65) Prior Publication Data

US 2020/0172328 A1 Jun. 4, 2020

(30) Foreign Application Priority Data

Nov. 30, 2018 (EP) ..... 18209534

(51) Int. Cl.
*B65D 90/20* (2006.01)
*B65D 19/18* (2006.01)
(Continued)

(52) U.S. Cl.
CPC ..... *B65D 90/20* (2013.01); *B65D 19/18* (2013.01); *B65D 19/36* (2013.01); *B65D 19/385* (2013.01);
(Continued)

(58) Field of Classification Search
CPC ..... B65D 90/20; B65D 19/18; B65D 19/36; B65D 19/385; B65D 88/022; B65D 88/54;
(Continued)

(56) References Cited

U.S. PATENT DOCUMENTS 3,940,018 A * 2/1976 Scholle ..... B65D 77/06 206/506
4,703,702 A * 11/1987 Speicher ..... B65D 19/385 108/52.1
(Continued)

FOREIGN PATENT DOCUMENTS

| | | | |
|---|---|---|---|
| EP | 0805115 | A1 | 11/1997 |
| JP | 07232791 | A | 9/1995 |
| WO | 2015042651 | A1 | 4/2015 |

OTHER PUBLICATIONS

Extended European Search Report for European Application No. 18 209 534.9, dated Jan. 17, 2019, 8 pages.

*Primary Examiner* — Kareen K Thomas
(74) *Attorney, Agent, or Firm* — Christopher A. Rothe; Culhane Meadows, PLLC

(57) ABSTRACT

A container for the transport and storage of goods includes an internal fillable tank and an external support structure surrounding the tank. The external support structure has a base structure arranged below the tank, such that a base of the tank is supported on the base structure. The external support structure also has an upper support structure arranged above the tank for absorbing loads exerted on the tank from above. The base structure includes a plurality of lower column portions, and the upper support structure includes a plurality of corresponding upper column portions, which each project from opposing faces of the base structure and the upper support structure respectively and which meet somewhere along the height of the tank, thereby forming a number of columns for laterally supporting the tank.

17 Claims, 7 Drawing Sheets

(51) Int. Cl.

| | |
|---|---|
| ***B65D 19/36*** | (2006.01) |
| ***B65D 19/38*** | (2006.01) |
| ***B65D 88/02*** | (2006.01) |
| ***B65D 88/54*** | (2006.01) |
| ***B65D 90/00*** | (2006.01) |
| ***B65D 90/02*** | (2019.01) |
| ***B65D 90/06*** | (2006.01) |
| ***B65D 90/14*** | (2006.01) |
| ***B65D 90/54*** | (2006.01) |

(52) U.S. Cl.
CPC ..... *B65D 88/022* (2013.01); *B65D 88/54* (2013.01); *B65D 90/0026* (2013.01); *B65D 90/021* (2013.01); *B65D 90/06* (2013.01); *B65D 90/146* (2013.01); *B65D 90/54* (2013.01); *B65D 2519/00034* (2013.01); *B65D 2519/0097* (2013.01); *B65D 2519/00139* (2013.01); *B65D 2519/00243* (2013.01); *B65D 2519/00273* (2013.01); *B65D 2519/00452* (2013.01)

(58) Field of Classification Search
CPC .. B65D 90/0026; B65D 90/021; B65D 90/06; B65D 90/146; B65D 90/54; B65D 2519/00034; B65D 2519/00139; B65D 2519/00243; B65D 2519/00273; B65D 2519/00452; B65D 2519/0097; B65D 2519/00318; B65D 2519/00323; B65D 2519/00572; B65D 2519/00621; B65D 2519/00666; B65D 2519/00975; B65D 2519/00208; B65D 2519/00288; B65D 2519/00796; B65D 2519/008; B65D 77/0466; B65D 25/56; B65D 2519/00069; B65D 2519/00174; B65D 2519/00333; B65D 2519/00502; B65D 2519/00711
See application file for complete search history.

(56) References Cited

U.S. PATENT DOCUMENTS

| | | | | | |
|---|---|---|---|---|---|
| 4,817,824 | A * | 4/1989 | LaFleur | B65D 90/205 | 222/105 |
| 5,025,925 | A * | 6/1991 | Wiklund | B65D 77/061 | 206/386 |
| 5,437,384 | A * | 8/1995 | Farrell | B65D 19/12 | 220/1.5 |
| 5,667,002 | A * | 9/1997 | Neustadt | B65D 88/14 | 160/368.1 |
| 5,897,012 | A * | 4/1999 | Sortwell | B65D 77/061 | 220/4.28 |
| 6,247,594 | B1 * | 6/2001 | Garton | B65D 19/04 | 206/512 |
| 6,514,009 | B2 * | 2/2003 | Northcott | B65D 88/78 | 220/23.91 |
| 6,602,032 | B2 * | 8/2003 | Arai | B65D 19/385 | 108/55.3 |
| 7,140,516 | B2 * | 11/2006 | Bothor | B65B 69/0075 | 222/185.1 |
| 2001/0051079 | A1 | 12/2001 | Arai | | |

* cited by examiner

INTERMEDIATE BULK CONTAINER

CROSS-REFERENCE TO RELATED APPLICATIONS

This application is related to and claims the benefit of priority under 35 U.S.C. § 119 of European Application No. 18 209 534.9, filed Nov. 30, 2018, the content of which is incorporated by reference herein in its entirety.

FIELD

The invention relates to a container for the transport and storage of, especially liquid or granulated, goods, more particular an intermediate bulk container, comprising a fillable internal tank and an external support structure enclosing said tank.

BACKGROUND

In the state of the art, various types of bulk containers are known for the transport and storage of (viscous) liquids, pastes, powders, granulates and the like. Oftentimes, so called Intermediate Bulk Containers (IBC) are used for this purpose. These usually comprise a fillable internal liner bag or tank and a supporting structure enclosing said tank or bag, thereby providing support and shielding to the tank or bag. Often, the supporting structure is implemented as a wire mesh cage, bar frame or the like. Intermediate bulk containers are generally stackable containers mounted on a pallet designed to be moved using a forklift or a pallet jack and often have a cuboid shape in order to maximally utilize the fill-volume that can be fitted on top of a standardized pallet.

The known supporting and shielding structures made of metal have numerous disadvantages such as the incomplete shielding because of the gaps in between the single wires/tubes or the susceptibility to corrosion, especially when transporting aggressive substances. Furthermore, such metal IBCs are laborious in their construction, since they have to be pieced together out of numerous single metal bars or tubes.

Further, foldable IBCs made of polymer are known to the state of the art. These have the disadvantage that they consist of a large number of single parts (multiple foldable walls), which results in a high number of necessary assembly operations.

SUMMARY

Because of the above stated disadvantages in known IBCs, the present invention is directed towards providing a container for the transport and storage of liquids, pastes, powders, granulates and the like, with a simple construction and a reduced number of assembly steps.

In accordance with the invention there is provided a container for the transport and storage of, especially liquid, granulated, powdered, viscous or paste-like, goods, more particular an intermediate bulk container, comprising an internal fellable tank and an outer support structure surrounding and supporting the tank. The support structure has a base structure on which a base wall of the tank is received and supported and an upper support structure arranged above the tank for protecting the tank from loads exerted on the tank from above, such as e.g. stacking loads. The base structure comprises a plurality of lower column portions which project upwards in a pillar-like fashion to form a receiving area therebetween, in which the tank is placed. The upper support structure comprises a plurality of corresponding upper column portions. The upward projecting portions and the downward projecting portions each project from opposing faces of the base structure and the upper support structure respectively and meet or connect with one another at a point along the vertical height of the container, thereby in forming a number of columns conjunction for supporting the tank in a lateral (horizontal) direction. In other words it could be said that the support structure forms a cage with a top portion a base structure and a plurality of peripheral columns surrounding and protecting the internal tank. The columns are divided into upper column portions, which is associated with the top portion, and lower column portions, which are associated with the base structure.

The above described design of the support structure poses the advantage that the amount of housing components necessary to provide effective support for the tank can be reduced, since each of the base structure and the upper support structure can shield and support multiple sides of the internal tank. Further, assembly and disassembly of the container is greatly facilitated, since the peripheral lower column portions of the base structure create a defined receiving area for the lower side of the tank, in which the tank may easily be received and aligned during assembly. Additionally a comparatively quick assembly is possible with only two assembly steps: placing the tank on the base structure; and placing the upper support structure onto the tank, such that the corresponding column portions mate/combine to form the plurality of supporting columns.

Preferably the tank and/or at least one of the housing components may be made of a plastic/polymer e.g. polyethylene or polypropylene. It is preferred, that the tank or bag and/or at least one of the housing components are manufactured in a molding process. It is further preferred all components are made of a plastic/polymer as e.g. polyethylene or polypropylene to improve ease of manufacture and recycling.

According to a preferred aspect of the invention the meeting/mating upper column portions and lower column portions forming the plurality of columns may be configured to be releasably connected.

According to a preferred aspect of the invention the meeting/mating upper column portions and lower column portions may meet/join between ⅕ and ⅘, preferably between ⅓ and ⅔, of the entire container height. In other words the interface between the upper support structure and the base structure may be located at a height between ⅕ and ⅘, preferably between ⅓ and ⅔ of the container height (in an upright position of the container). The applicant has found this to result in an easy accessibility of the interface, while maintaining the defined receiving area for the tank on the base structure.

According to a preferred embodiment, the lower base structure can comprise a (at least partially) circumferential wall portion on its upper face, which extends in an upwards direction and which connects the plurality of upward projecting portions of the base structure. This feature further helps to define the receiving area for the tank. Preferably, in such an embodiment a base wall of the tank may be formed complementarily to the circumferential wall portion, such that the tank is received on the base structure form fittingly with little clearance. Advantageously, the circumferential wall portion may be provided with a recess or cut-out adapted to receive a lower outlet valve of the tank. This allows the valve to be accessed through the support structure and also provides a Poka-Yoke function by only allowing one orientation of the tank during assembly.

According to an aspect of the invention the support structure may produce a cuboid outer shape or silhouette of the container. This aids the stackability of a plurality of identical containers. In this case the base structure may comprise a lower column portion in each of its corners and the upper support structure may comprise a corresponding upper column portion in each of its corners. In other words, in a preferred embodiment the upper and lower column portions may form four corner columns, when joined together.

According to a preferred embodiment, the support structure can further comprise a reinforcing profile arranged in at least one of the columns, preferably in each of the columns, such that it extends internally along the length direction of the lower column portion and upper column portion of the respective column. In other words a reinforcing profile or bar or rail or rod may be installed within at least one of the plurality of columns, such that it supports and reinforces both the upper and the lower column portion of said column. Such design is beneficial for providing the necessary strength for the uptake of stacking forces.

According to a preferred embodiment, the support structure can alternatively or additionally comprise at least one further reinforcing profile extending parallel to and arranged in between two columns, such that it directly supports a side wall portion of the tank that is exposed between said two columns laterally. Through such design the tank is additionally laterally supported by the reinforcing profile in an area that is not supported by the plurality of columns. This prevents outward bulging of the tank sidewall in said area thereby increasing pressure strength of the container combination.

According to an aspect of the invention the at least one reinforcing profile may be an extrusion profile made of a polymer/plastic material. Preferably it may be a hollow extruded profile. This allows to maximize the amount of plastic components in the container thereby improving recyclability.

According to a preferred embodiment, the tank may comprise at least one protruding side wall portion, which outwardly protrudes into a window formed between the base structure, the upper support structure and two columns, thereby increasing the internal volume of the tank. Preferably the protruding portion of the tank side wall may be complementarily shaped to said window and formed such that it aligns with the face of the side wall structure of the support structure. In other words, in a preferred embodiment at least one side wall section of the tank that is exposed between two of the plurality of columns may bulge outwards through the opening formed between said two columns such that it compliments a general cuboid shape of the entire container combination. Alternatively, the protruding side wall portion may be slightly indented with respect to the lateral face of the support structure.

In a further preferred embodiment of the invention, wherein the container comprises four corner columns, there may be four such windows with inserted protruding side wall portions of the tank, one on each lateral face of the container. With this design the volume of the tank may be maximized without compromising the stacking strength of the support structure.

According to an aspect of the invention the at least one protruding portion of the tank side wall may comprise a groove extending in a parallel direction to the columns delimiting the window (in vertical direction of the container) and the at least one reinforcing profile that laterally supports the protruding side wall portion may be arranged within said groove.

According to a preferred embodiment, the base structure may comprise a pallet portion on its lower face that is configured to cooperate with a forklift, pallet jack and the like. Preferably, the pallet portion may comprise a separate skid portion for this purpose, which is detachably connected to the lower face of the pallet portion.

According to a preferred embodiment, the upper face of the upper support structure may comprise a plurality of stacking geometries, which are engageable with corresponding stacking geometries on the lower face of the pallet portion and/or the skid portion of a structurally identical container. In other words, stacking geometries may be provided according to forming a positive lock that prevents lateral movement in stacked containers.

According to an aspect of the invention the lower face of the skid portion may be recessed along its circumferential edge and configured to receive corresponding circumferential stacking projections arranged on the upper face of the upper support structure. In other words the stacking geometry may be formed by (intermittent) circumferential protrusion on the top face and a complementary recess on the bottom face of the support structure or vice versa. This design of the stacking structure allows for easier positioning for stacking.

According to a preferred embodiment, the lower column portion or the upper column portion may be connected by means of fasteners. For this purpose the lower column portion in the upper column portion of a column may comprise an area of vertical overlap with a concentric fastener opening extending through both the lower column portion and the upper column portion in said area of overlap into which said fasteners may be inserted. Preferred embodiments of such fasteners may be screws, bolts or bayonet fasteners for example.

According to an aspect of the invention the skid portion may be connected to the base structure with a plurality of fasteners, wherein said fasteners may preferably be structurally identical to the fasteners connecting the lower column portion or the upper column portion. Such an embodiment has the advantage that only one type of fastener is needed for the assembly of the entire container.

Preferably, the tank can comprise at least one inlet opening, more particular an inlet opening located on or near/adjacent to an upper side of the tank. In such an embodiment the upper support structure may comprise a window in its top face to provide access to said inlet opening. According to an additional aspect, the tank or bag may comprise at least one outlet opening, more particular an outlet opening located near/adjacent to a lower side of the tank. It is further preferred that the base structure comprises a recess in its circumferential wall corresponding said outlet opening thereby making the same accessible to external operation.

According to an further independent aspect of the invention the tank may comprise an outlet valve arranged in proximity to its lower side and the base portion may comprise a base locking geometry on its lower side configured to engage a valve locking geometry arranged on a lower side of the outlet valve and extending towards the base portion. The base locking geometry and the valve locking geometry can advantageously engage in a positive lock that inhibits rotation of the outlet valve along its longitudinal axis.

BRIEF DESCRIPTION OF THE DRAWING FIGURES

Embodiments of the invention will now be described by way of example and with reference to the accompanying drawings, in which.

DETAILED DESCRIPTION

Figure 1:
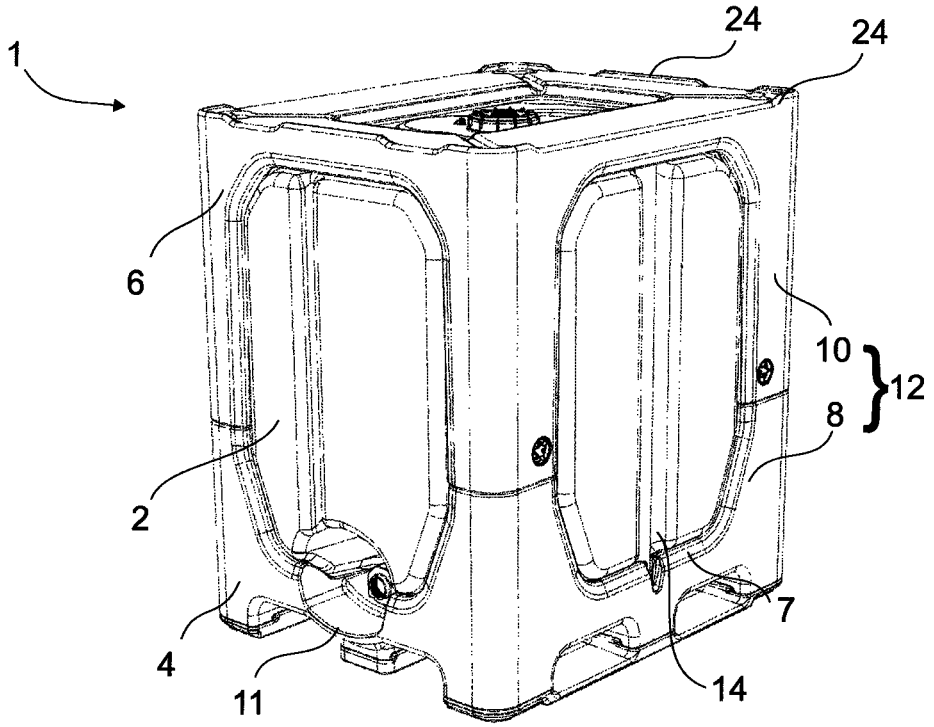
FIG. 1 is a perspective view of a container according to a preferred embodiment of the invention.

FIG. 1 shows a preferred embodiment of the container according to the invention in a perspective view. In particular, the shown container is a so-called intermediate bulk container (IBC) configured for the storage and transportation of large volumes of fluids, pastes, powders and the like. The container according to the depicted preferred embodiment has a fill volume of approximately 1000 liters. IBC type containers are usually mounted on top of a standard pallet or comprise a pallet-like (forklift compatible) lower section. Compared to the classical transport of liquid or granulated goods in steel barrels stacked on top of a pallet, IBCs provide the advantage of optimally utilizing the fill-volume provided by the pallet-format and reducing the net weight of the packaging. Furthermore, with typical 200 liter barrels, 5 working steps are necessary to withdraw the same amount of goods, when compared to one working step to withdraw 1000 liters from the depicted IBC.

Fundamentally, the container 1 according to the preferred embodiment is structured such that it has an internal tank 2 defining the fill volume of the container 1 and having an inlet and an outlet opening and an external support structure 4, 6 encaging the internal tank 2 and supporting it in order to protect the tank 2 from outside damage and to provide the necessary structural integrity for stacking multiple such containers 1. The support structure 4, 6 in turn comprises a base structure 4 on which the tank 2 is supported as well as an upper support structure 6 that frames the top side of the tank 2, thus protecting the tank 2 from loads exerted from above, such as e.g. stacking loads.

The base structure 4 of the support structure 4, 6 of the preferred embodiment has a generally rectangular cross-section when viewed from above and comprises four integrally formed lower column portions 8, which are arranged in each of the four corners of the base structure 4 and extend in an upward direction of the container 1. The base structure 4 further comprises a peripheral, circumferential wall section 7, which connects the lower column portions 8 along the edges of the base structure 4 and together with these forms a receiving area 9 for the lower side of the tank 2 on the upper face of the base structure 4. The circumferential wall portion 7 in the depicted embodiment is provided with an opening or cut-out 11 adapted to receive a lower outlet valve 13 of the tank 2. This allows the valve to be accessed through the support structure and also provides a Poka-Yoke function by only allowing one orientation of the tank during assembly.

Although not explicitly depicted, the base wall of the tank 2 as well as a top surface of the base structure 4 that receives said base wall are slightly slanted towards the lower outlet valve 13 of the tank 2 to facilitate complete depletion of the tanks contents.

The upper support structure 6 also has a rectangular cross-section when viewed from above and comprises four upper column portions 10, which are arranged in the corners of the upper support structure 6 and extends downwards towards the base structure 4. In an assembled state of the container 1, the lower column portions 8 and the upper column portions 10 combine to form four corner columns or posts 12, thereby connecting the base structure 8 and the upper support structure 10 and laterally supporting the edges of the tank 2. The columns 12 also allow for stackability of the container 1 by transferring stacking loads vertically, while bypassing the tank 2.

In order to improve handling during assembly of the container 1 according to the preferred embodiment, the interface, where the lower column portion 8 and the upper column portion meet, is positioned at about one third of the entire container 1 height. This has been advantage that the lower column portions 8 can still effectively define a receiving area for the tank 2, while the tank 2 does not have to be lifted as high, in order to be inserted onto the base structure 4 as is the case in other IBCs known from prior art, where the supporting cage extends substantially along the entire height of the container 1. Further, such a height of the interface between the base structure 4 and the upper support structure 6 has proven to be an ergonomically comfortable height for assembly personnel, when securing the upper support structure 6 with the base structure 4 as will be elaborated later on.

As will be described in detail later on, the corner columns 12 are further reinforced by reinforcing profiles 14 which insert into both the lower column portions 8 and the upper column portions 10 thereby strengthening the connection between these portions 8, 10 and further increasing the mechanical stability of the columns 12 and facilitating the absorption and transfer of stacking loads by the columns 12.

Figure 2:
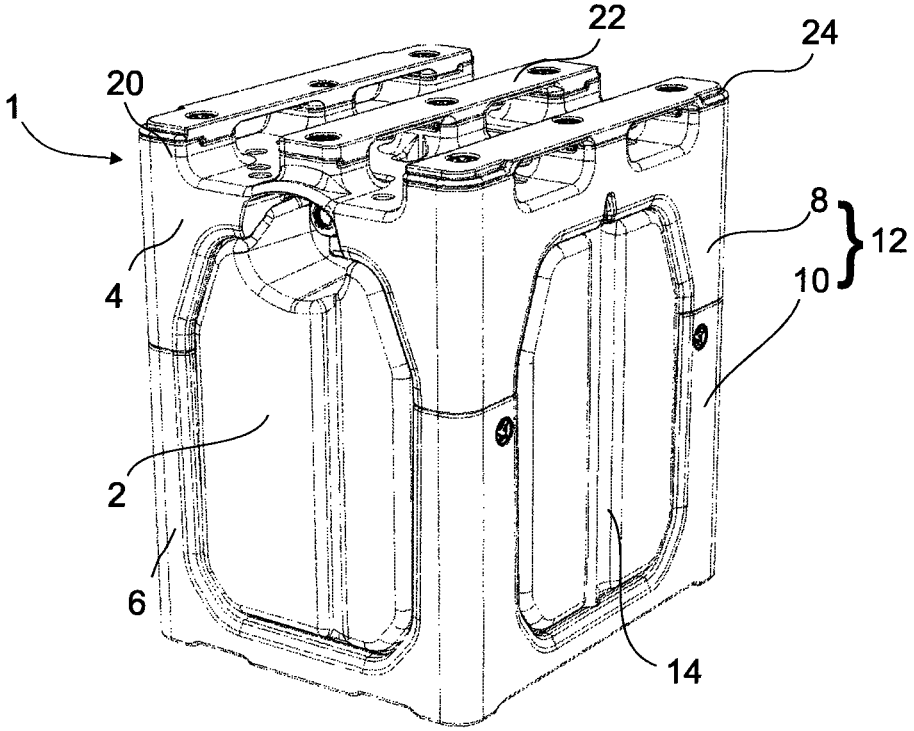
FIG. 2 is a perspective bottom view of the container according to the preferred embodiment of the invention.

FIG. 2 shows a perspective view of the underside of the container 1 according to the preferred embodiment. This figure showcases the pallet shaped underside of the base structure 4 which allows handling via forklifts and the like and which will be explained in greater detail later on. A further feature of the base structure is a hole-pattern 5, which provides additional strength and stiffness to the middle of the base structure 4 (the parts lifted by forklift forks and the like).

Figure 3:
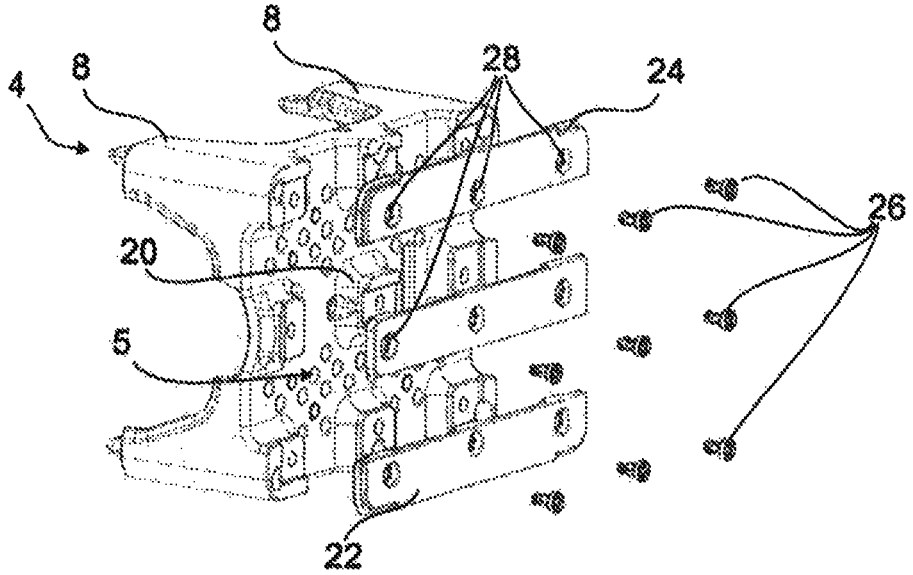
FIG. 3 is a view of a subassembly of the container according to the preferred embodiment of the invention.

As best seen in FIG. 3, the pallet shaped base structure 4 comprises a separate, attachable skid portion 22, which can be releasable fastened to the underside of the base structure by a number of fasteners 26 inserted into corresponding bores 28. The fasteners 26 can preferably be made (molded) of plastic (polymer) material and could be formed e.g. as screws, bolts, bayonet fasteners or the like.

FIG. 3 can also be seen as a starting point of a bottom up assembly of the container 1 according to the preferred embodiment of the invention, in which said skid portion 22 is fixed to the pallet portion 20 of the base structure 4 by inserting fasteners 26 into concentric bores provided both in the skid portion 22 and the pallet portion 20 of the base structure 4.

Figure 4:
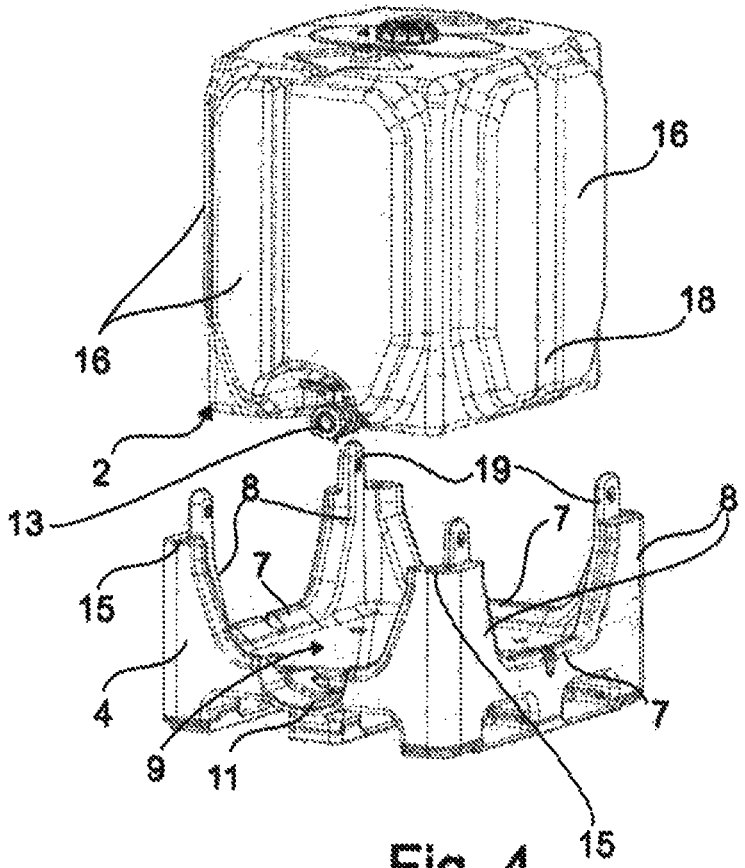
FIG. 4 is a view of a subassembly of the container according to the preferred embodiment of the invention.

After the skid portion 22 is fastened to the underside of the base structure 4, the base structure 4 can be placed into an upright position and the tank 2 can be placed on top of the base structure 4 into the receiving area 9 formed by the circumferential wall section 7 of the base structure 4 and the lower column portions 8, as is shown in FIG. 4.

FIG. 4 also highlights a structural feature of the tank 2 according to the preferred embodiment of the invention, which is the protruding side wall portions 16 of the tank. The tank has a cuboid base shape. However the lateral faces of said cuboid base shape are designed such that they bulge outwardly through the windows formed by two neighboring columns 12, the base structure 4 and the upper support structure 6. This allows the tank to "fill out" the remaining volume formed between said windows and the generally cuboid shape or silhouette of the support structure 4, 6 that would otherwise be wasted. Accordingly, the protruding side wall portions 16 of the tank 2 are flattened to level with the cuboid outer silhouette of the support structure 4, 6.

Figure 5:
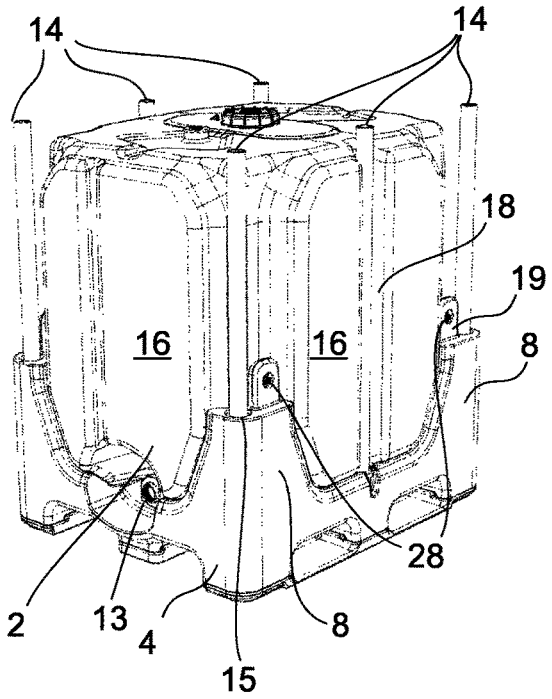
FIG. 5 is a view of a subassembly of the container according to the preferred embodiment of the invention.

In a next assembly step best seen in FIG. 5, reinforcing profiles 14 are inserted into profile receiving recesses (or bores) 15 that are provided peripherally in the base structure 4 for this purpose. One reinforcing profile 14 is inserted into each of the lower column portions 8 (which each comprise a profile receiving recesses 15 for this purpose) and additional reinforcing profiles 14 are arranged between two neighboring lower column portions 8, thereby laterally supporting the tank 2 side wall portion 16 that is exposed between said two neighboring lower column portions 8 (respectively between the two neighboring columns 12). Such intermediate reinforcing profiles 14 are provided on each of the sides of the cuboid support structure 6 with the exception of the side in which the lower outlet valve 13 to is arranged to improve the strength of the container 1 against pressure loads placed on the tank 2. Since the tank side wall portions 16 protrude outwards, grooves 18 are provided therein to accommodate the intermediate reinforcing profiles 14.

Figure 6:
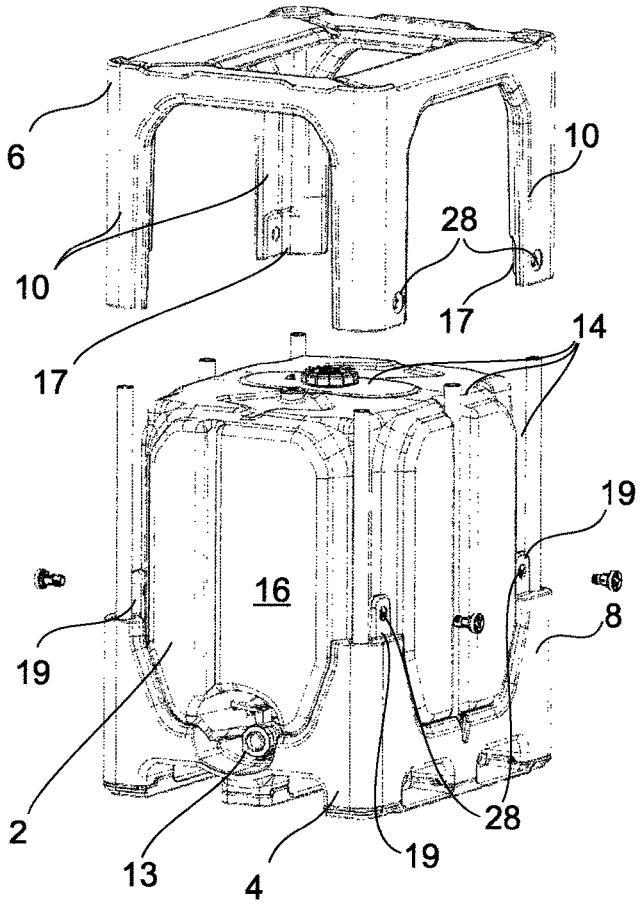
FIG. 6 is a view of a subassembly of the container according to the preferred embodiment of the invention.
Figure 7:
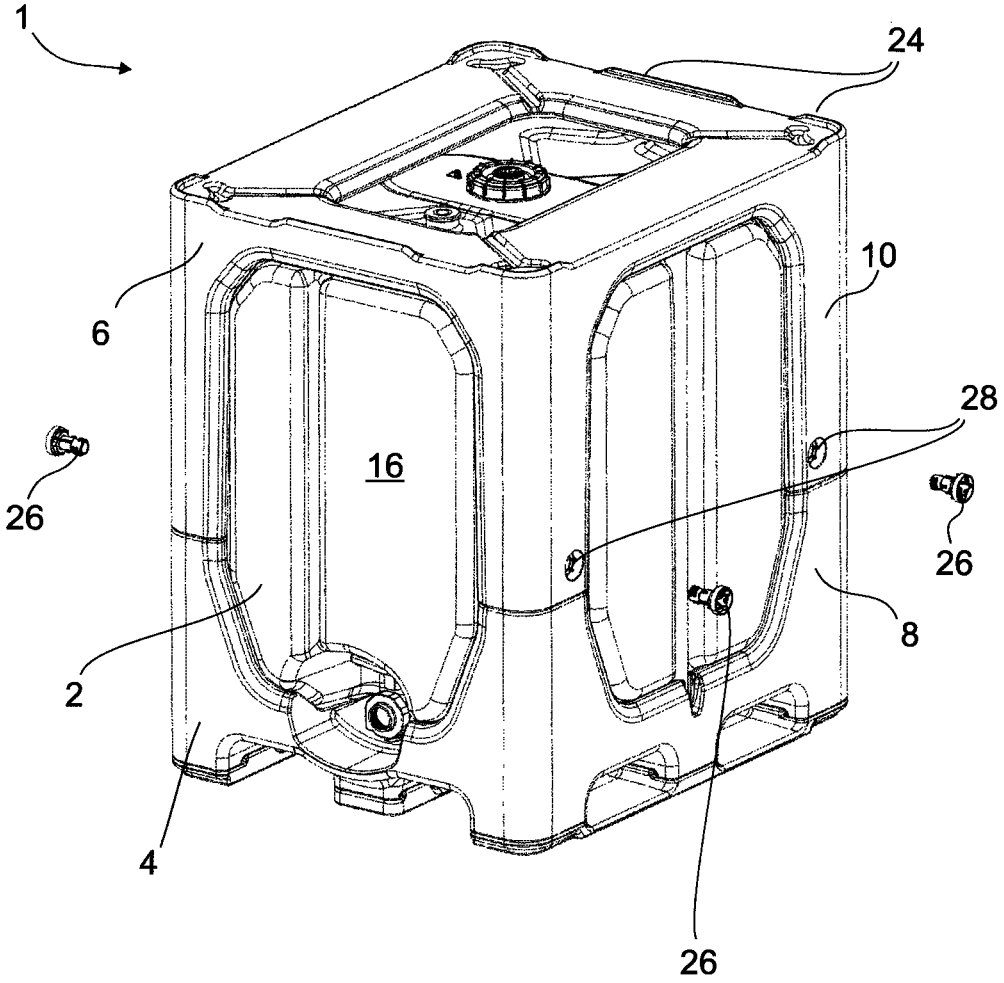
FIG. 7 shows the insertion of the fasteners for assembling the support structure of the container according to the preferred embodiment.

FIG. 6 depicts the next assembly step, in which the upper support structure 6 is placed on top of the container 1 as assembled thus far. Naturally, the lower face of the upper support structure 6 is provided with profile receiving recesses 15, in order to accommodate the reinforcing profiles 14 extending from the lower subassembly. Additionally, the free ends of the upper column portions 10, which mate with the upper ends of the lower column portions 8, are provided with fastening recesses 17 for receiving fastening protrusions 19 arranged on said upper ends of the lower column portions 8. As the skilled person will appreciate, this arrangement may also be inversed as long as there is an area of overlap between the upper support structure 6 and the base structure 4. In the depicted preferred embodiments each upper column portion 10 and each fastening protrusion 19 comprise a coaxial bore 28 (in the assembled state), which is configured to receive a releasable fastener 26. In this case, the fasteners 26 for connecting the base structure 4 with the upper support structure 6 are identical to the fasteners connecting the skid portion 22 to the base structure 4. This reduces the variety of parts necessary for manufacturing the container 1 according to the preferred embodiment of the invention. Since in the depicted preferred embodiment the fasteners 26 are constructed as plastic molded parts, a single molding tool will suffice for their production. The insertion of the fasteners 26 into the receiving bores 28 of the lower column portions 8 and the upper column portions 10 is shown in FIG. 7.

Figure 8:
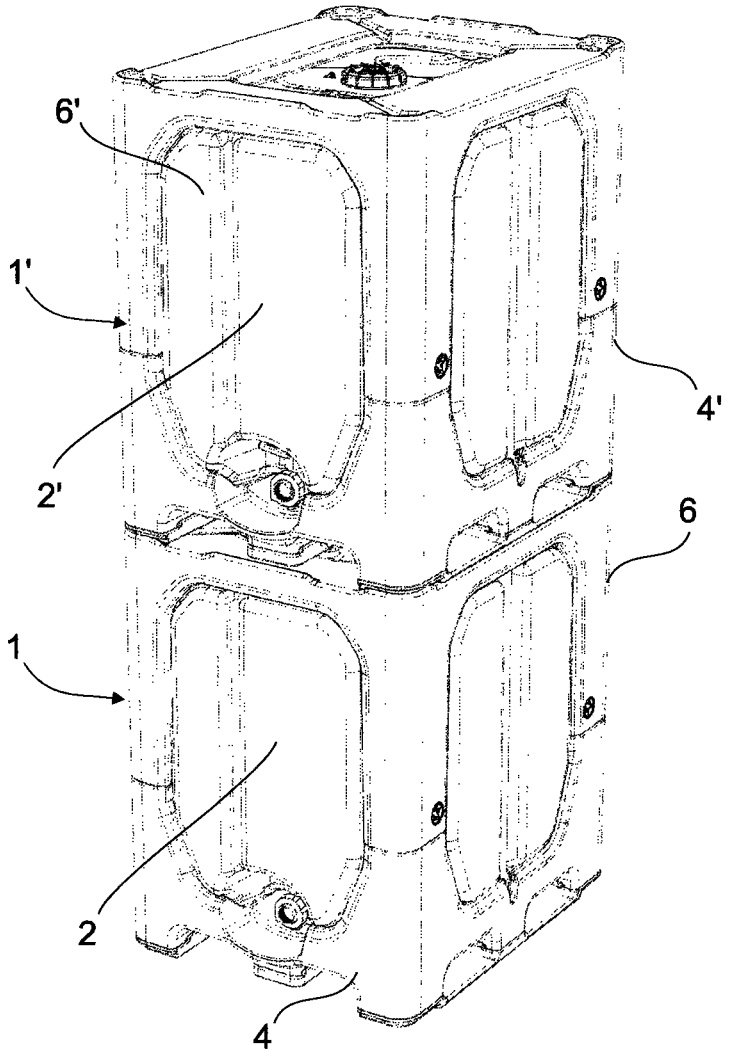
FIG. 8 shows to structurally identical containers according to the preferred embodiment in a stacked arrangement.

FIG. 8 shows two structurally identical containers 1, 1' according to the invention in a stacked position. The reinforced corner column 12 structure provides good stacking strength and an optimized load transfer through the corner columns and thus allows stacking of containers 1, even in a filled state of the containers 1, 1'.

Figure 9:
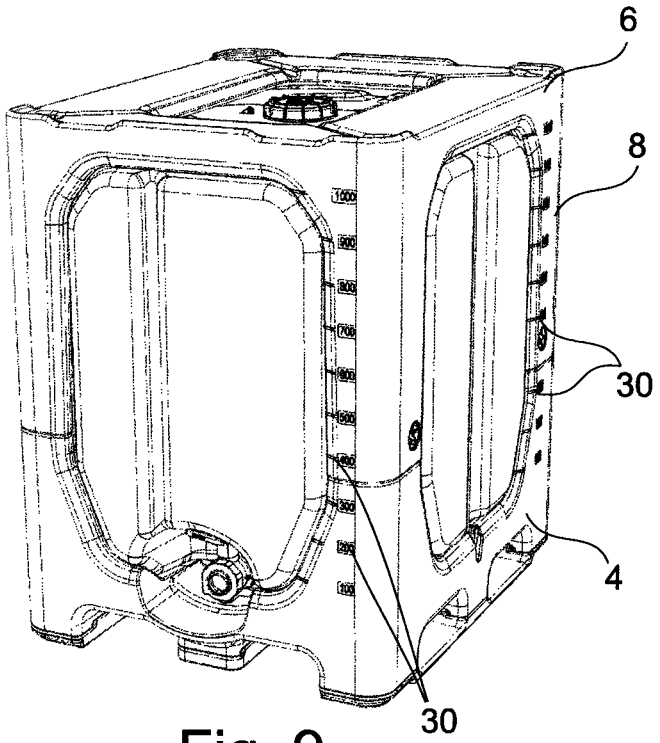
FIG. 9 shows a fill level indicating feature of the container according to the preferred embodiment.

FIG. 9 highlights a further feature of a container 1 according to a preferred embodiment of the invention. The tank 2 shown here is made of an at least partially transparent polymer material. Because in such an embodiment the fill level is perceivable through the tank wall, a fill scale 30 indicating the fill level may be provided on one of the columns 12 framing an exposed tank sidewall portion 16. Preferably this fill scale 30 is provided on a front side wall portion 16 of the tank 2 also carrying the lower outlet valve 13, such that the fill level can be monitored while emptying the container 1. Said fill scale 30 depicted in FIG. 9 starts on the lower end of the lower column portion 8 and seamlessly continues on to the corresponding upper column portion 10 of the same column 12.

Figure 10:
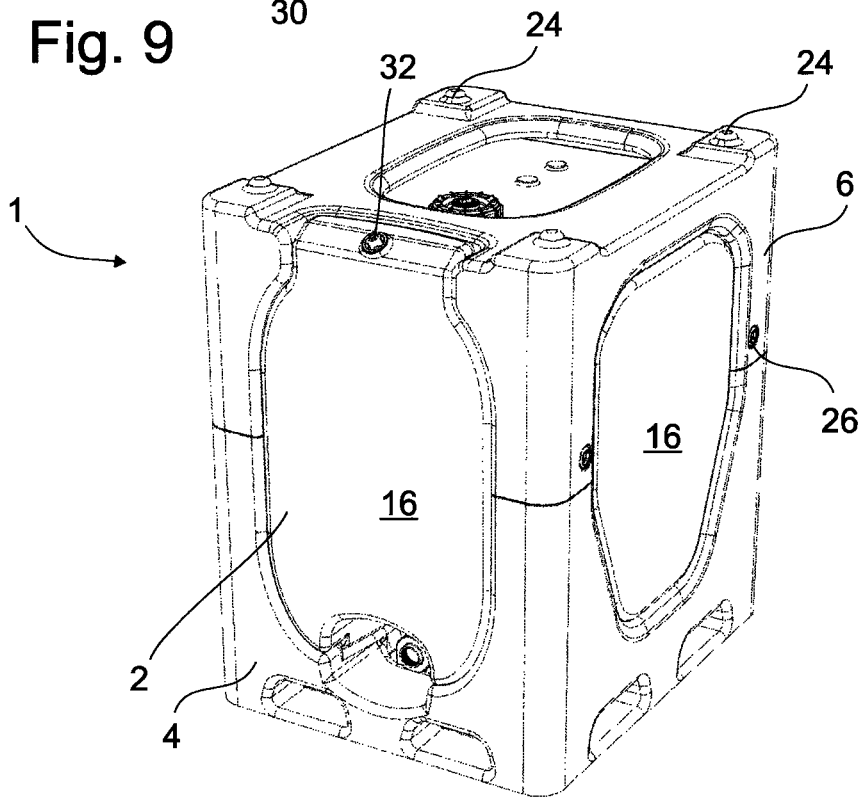
FIG. 10 shows an alternative embodiment of the invention.

FIG. 10 discloses an alternative embodiment of the present invention. The disclosed container 1 has many structural similarities with the aforementioned container 1 of the preferred embodiment. In the following, for the sake of brevity, only differences between the embodiments will be discussed. One difference is the height in which the lower column portions 8 and the upper column portions 10 meet or the height of the interface, which in this case is about half the height of the entire container 1. Furthermore, the front window between the two front columns 12 is extended upwards (cut-out at its upper rim) such that an extra sampling opening 32 may be provided and accessed in the top front edge of the tank 2. Such a sampling opening 32 can be beneficial for certain use cases. Such an embodiment however has the drawback that the structural integrity of the upper support structure 6 is compromised by the extended front window. Lastly, this embodiment shows an alternative stacking geometry on the top face of the upper support structure 6, comprising stacking protrusions 24 in each corner of such top face which are completely received by corresponding recesses (not shown) on the underside of the base structure 4.

Figure 11A:
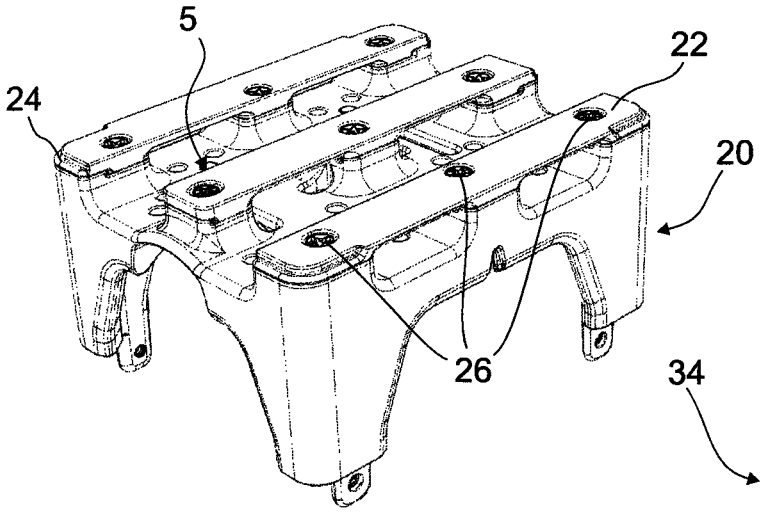
FIG. 11A shows a detailed view of a skid portion.
Figure 11B:
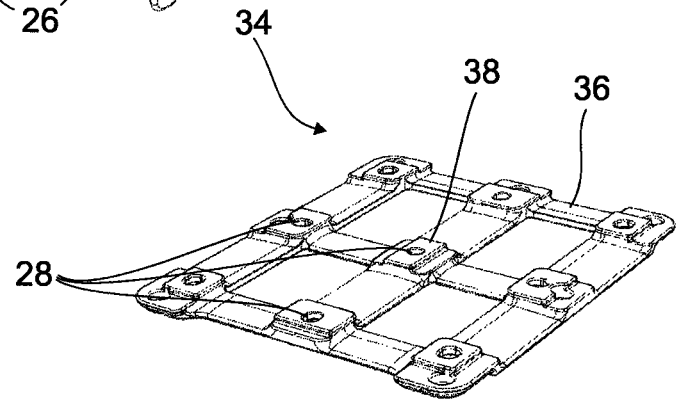
FIG. 11B shows an alternative version of a skid portion.

FIGS. 11A and 11B show the container 1 according to the preferred embodiment of the invention having multiple, exchangeable variations of skid portions. In particular a base structure 4 is depicted, on which a first variation of a skid portion 22 is mounted. This first variation is designed to form a so called "three skid pallet" that comprises three parallel elongated skids and is easy to handle with devices such as pallet wagons, fork lifts or pallet-jacks. A second variation of an exchangeable skid portion 34 is shown next to the assembled base structure 4. The second variation forms a so called parametrical skid. Such skids 34 have one circumferential skid portion 36 and one central skid portion 38 arranged centrally within the circumferential skid portion 36 and provide the benefit of a more secured handling via forklift forks, when compared to e.g. three skid versions.

The bores 28 for inserting the fasteners 26 in the pallet portion 20 of the base structure 6 and the skid portions 22, 34 are arranged in three symmetrically aligned rows of three in the shown embodiment. As the skilled person will appreciate, various placements of the bores 28 are possible as long as said placement is congruent between the pallet portion 20 of the base structure 6 and the skid portions 22, 22'.

Figure 12:
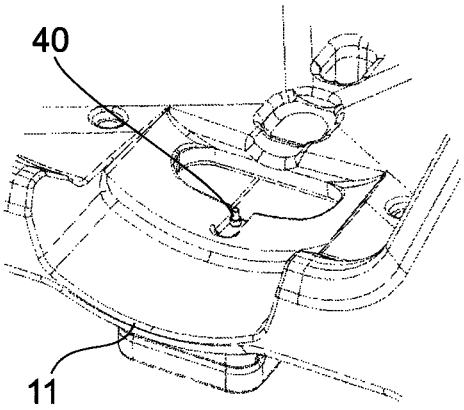
FIG. 12 shows an anti-rotation device according to a preferred embodiment of the invention.
Figure 13:
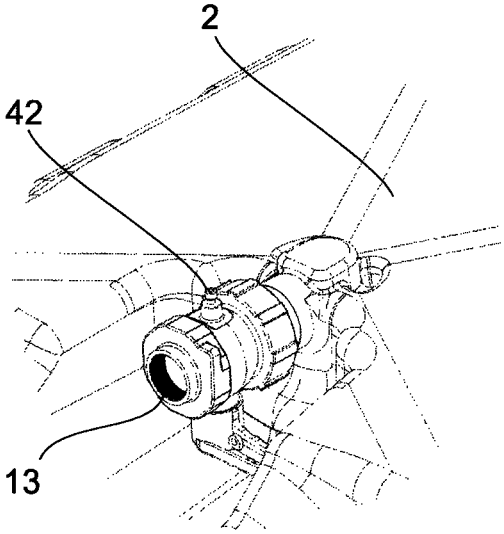
FIG. 13 is another view of the anti-rotation device of FIG. 12.

FIGS. 12 and 13 depict another feature of the container 1 of the preferred embodiment, which could provide subject-matter for a separate application. In particular an anti-rotation device for the lower outlet valve 13 is disclosed that comprises a base locking geometry 40 arranged in the valve opening 11 of the base structure 4 of the container 1. This base locking geometry 40 is configured to engage with a complementary valve locking geometry 42 arranged on the underside of the lower outlet valve 13 and extending towards the base structure 4. In a state, in which the tank 2 is mounted on the base structure 4, the base locking geometry 40 and the complementary valve locking geometry 42 engage, such that a positive lock is formed between the valve 13 and the base structure 4, at least in the direction perpendicular to the outlet valve's 13 axial direction. This anchors the lower side of the lower outlet valve 13 against any rotational forces which can occur for example when a valve handle that is arranged opposite to the valve locking geometry 42 on the valve 13 is operated. In the depicted embodiment the two locking geometries 40, 42 are designed at two coaxial protrusions of which one (in this case the valve locking geometry 42) forms a socket for receiving the other locking geometry (base locking geometry 40).

The invention claimed is:

1. A container for transport and storage of goods comprising:

an internal fillable tank; and an external support structure surrounding the tank, the external support structure comprising:

a base structure arranged below the tank, such that a base of the tank is supported thereon; and an upper support structure arranged above the tank for absorbing loads exerted on the tank from above, the base structure comprising a plurality of lower column portions, which project in an upward direction of the container, the upper support structure comprising a plurality of corresponding upper column portions, which project in a downward direction of the container, such that each of the lower column portions meets and combines with one of the upper column portions, in order to form a plurality of columns for laterally supporting the tank, the external support structure further comprising a reinforcing profile arranged internally in at least one of the plurality of columns such that the reinforcing profile extends internally along a length direction of a lower column portion and an upper column portion of said at least one of the plurality of columns, each reinforcing profile being inserted into a profile receiving recess of the upper column portion and into a profile receiving recess of the lower column portion so as to transfer stacking loads from the upper support structure to the base structure.

2. The container of claim 1, wherein the external support structure produces a cuboid outer shape of the container, the base structure comprises the lower column portion in each of its four corners and the upper support structure also comprises the corresponding upper column portion in each of its four corners, such that four corner columns are formed.

3. The container according to claim 1, wherein the external support structure further comprises an intermediate reinforcing profile extending from the base structure to the upper support structure in a direction parallel to and arranged in between two columns, such that it laterally supports a side wall portion of the tank that is exposed between said two columns.

4. The container according to claim 1, wherein the reinforcing profile is an extrusion profile made of a plastic material.

5. The container according to claim 3, wherein the tank comprises at least one protruding portion, which outwardly protrudes into a window formed between the base structure, the upper support structure and two columns, thereby increasing an internal volume of the tank.

6. The container according to claim 5, wherein the at least one protruding portion comprises a groove extending in a parallel direction to the columns delimiting the window and wherein the intermediate reinforcing profile is arranged within said groove of the tank to laterally support the at least one protruding portion.

7. The container according to claim 1, wherein the base structure comprises a pallet portion on its lower face configured to cooperate with a forklift or pallet jack.

8. The container according to claim 7, wherein the pallet portion comprises a skid portion, which is detachably connected to its lower face.

9. The container according to claim 8, wherein the upper face of the upper support structure comprises a plurality of stacking geometries which are engageable with corresponding stacking geometries on the lower face of the pallet portion and/or the skid portion of a structurally identical container.

10. The container according to claim 9, wherein circumferential edges of the lower face of the skid portion are recessed and configured to receive corresponding circumferential stacking projections arranged on the upper face of the upper support structure.

11. The container according to claim 8, wherein at least one lower column portion and one upper column portion are releasably connected with one another by a fastener.

12. The container according to claim 11, wherein the skid portion is connected to the base structure with a plurality of fasteners, wherein said fasteners are structurally identical to the fasteners connecting the lower column portion or the upper column portion.

13. The container according to claim 1, wherein the container has a container height, and wherein the interface, where the lower column portions and the upper column portions meet, is arranged between 1/5 and 4/5 of the container height.

14. The container according to claim 1, wherein the tank comprises an outlet valve arranged in proximity to its lower side and the base portion comprises a base locking geometry on its lower side configured to engage and interlock with a valve locking geometry arranged on a lower side of the outlet valve and extending towards the base portion, thus forming a direct positive lock between the outlet valve and the base portion.

15. A container for transport and storage of goods comprising:

a fillable tank having an internal volume; and an external support structure surrounding the tank, the external support structure comprising:

a base structure arranged below the tank, such that a base of the tank is supported thereon; and an upper support structure arranged above the tank for absorbing loads exerted on the tank from above, the base structure comprising a plurality of lower column portions, which project in an upward direction of the container, the upper support structure comprising a plurality of corresponding upper column portions, which project in a downward direction of the container, such that each of the lower column portions meets and combines with one of the upper column portions, in order to form a plurality of columns for laterally supporting the tank, the upper column portions and the lower column portions forming at least one window between the base structure and the upper support structure, and the tank comprising at least one protruding portion that bulges outwardly into the at least one window so that a space between said upper column portions and said lower column portions forming the at least one window is utilized for a portion of the internal volume of the tank.

16. The container according to claim 15, wherein the external support structure further comprises a reinforcing profile arranged internally in at least one of the plurality of columns such that the reinforcing profile extends internally along a length direction of a lower column portion and an upper column portion of said at least one of the plurality of columns.

17. The container according to claim 15, wherein:

the at least one protruding portion comprises a groove extending in a direction parallel to the upper column portions and the lower column portions, and the intermediate reinforcing profile is arranged within said groove to laterally support the at least one protruding portion.

* * * * *